US009090059B1

(12) United States Patent
Sayama et al.

(10) Patent No.: US 9,090,059 B1
(45) Date of Patent: Jul. 28, 2015

(54) PRINTING APPARATUS AND CONTROL METHOD AND PROGRAM THEREOF

(71) Applicant: SEIKO EPSON CORPORATION, Tokyo (JP)

(72) Inventors: Tomohiro Sayama, Nagano (JP); Toru Matsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/635,019

(22) Filed: Mar. 2, 2015

(30) Foreign Application Priority Data

Mar. 7, 2014 (JP) ..... 2014-044566

(51) Int. Cl.
*B41J 29/38* (2006.01)
*B41J 2/045* (2006.01)

(52) U.S. Cl.
CPC ..... *B41J 2/04505* (2013.01); *B41J 2/04581* (2013.01); *B41J 2/04588* (2013.01)

(58) Field of Classification Search
USPC ..... 347/5, 9, 10, 16, 19, 70
See application file for complete search history.

(56) References Cited

U.S. PATENT DOCUMENTS 6,151,050 A * 11/2000 Hosono et al. ..... 347/70
6,161,912 A * 12/2000 Kitahara et al. ..... 347/9
8,371,685 B2 2/2013 Kusunoki et al.
2008/0030531 A1 * 2/2008 Gao et al. ..... 347/9

FOREIGN PATENT DOCUMENTS

JP 2009-178867 A 8/2009
JP 2010-194750 A 9/2010
JP 2011-161828 A 8/2011

* cited by examiner

*Primary Examiner* — Lam Nguyen
(74) *Attorney, Agent, or Firm* — Global IP Counselors, LLP

(57) ABSTRACT

A printing apparatus includes a piezoelectric element; a cavity whose internal volume is increased or decreased by displacement of the piezoelectric element; a nozzle connected to the cavity and ejecting the ink as ink droplets onto a print medium by increasing or decreasing of the internal volume of the cavity; a printing mode receiver receiving selection of at least one photographic paper printing mode for printing onto photographic paper and at least two plain paper printing modes for printing onto plain paper from among printing modes; and a control unit controlling a meniscus position in the nozzle to be separated further from an orifice surface of the nozzle when the selection of one plain paper printing mode from among the at least two plain paper printing modes is received by the printing mode receiver than when the selection of the photographic paper printing mode is received.

5 Claims, 14 Drawing Sheets

<PRINTING MODE TABLE>

| | Type Of Printing Medium | Type Of Print Quality | Number Of Overlaps Number | Lap Unit | Meniscus Mode |
|---|---|---|---|---|---|
| Plain Paper Printing Mode | Plain Paper | Fast | 1 | 1 | Normal |
| | | Pretty | 4 | 1-2 | Normal |
| | | | | 3-4 | High |
| | Recycled Paper | Fast | 1 | 1 | Normal |
| | | Pretty | 4 | 1-2 | Normal |
| | | | | 3-4 | High |
| | Fine Paper | Fast | 4 | 1-4 | Normal |
| | | Pretty | 8 | 1-4 | Normal |
| | | | | 5-8 | High |
| Photographic Paper Printing Mode | Photo Paper | Fast | 8 | 1-8 | Normal |
| | | Pretty | 16 | 1-16 | Normal |
| | Glossy Photo Paper | Fast | 4 | 1-4 | Normal |
| | | Pretty | 8 | 1-8 | Normal |
| | Matte Photo Paper | Fast | 4 | 1-4 | Normal |
| | | Pretty | 8 | 1-8 | Normal |
| | Coated Paper | Fast | 4 | 1-4 | Normal |
| | | Pretty | 8 | 1-8 | Normal |
| | Glossy Photographic Paper | Fast | 4 | 1-4 | Normal |
| | | Pretty | 16 | 1-16 | Normal |
| | Matte Photographic Paper | Fast | 16 | 1-16 | Normal |
| | | Pretty | 32 | 1-32 | Normal |
| Cloth Printing Mode | Synthetic Fibers | Fast | 4 | 1-4 | High |
| | | Pretty | 16 | 1-16 | High |
| | Natural Fibers | Fast | 4 | 1-4 | High |
| | | Pretty | 16 | 1-8 | High |
| | | | | 9-16 | Normal |

<PRINTING MODE TABLE>

| | Type Of Printing Medium | Type Of Print Quality | Number Of Overlaps Number | Lap Unit | Meniscus Mode |
|---|---|---|---|---|---|
| Plain Paper Printing Mode | Plain Paper | Fast | 1 | 1 | Normal |
| | | Pretty | 4 | 1-2 | Normal |
| | | | | 3-4 | High |
| | Recycled Paper | Fast | 1 | 1 | Normal |
| | | Pretty | 4 | 1-2 | Normal |
| | | | | 3-4 | High |
| | Fine Paper | Fast | 4 | 1-4 | Normal |
| | | Pretty | 8 | 1-4 | Normal |
| | | | | 5-8 | High |
| Photographic Paper Printing Mode | Photo Paper | Fast | 8 | 1-8 | Normal |
| | | Pretty | 16 | 1-16 | Normal |
| | Glossy Photo Paper | Fast | 4 | 1-4 | Normal |
| | | Pretty | 8 | 1-8 | Normal |
| | Matte Photo Paper | Fast | 4 | 1-4 | Normal |
| | | Pretty | 8 | 1-8 | Normal |
| | Coated Paper | Fast | 4 | 1-4 | Normal |
| | | Pretty | 8 | 1-8 | Normal |
| | Glossy Photographic Paper | Fast | 4 | 1-4 | Normal |
| | | Pretty | 16 | 1-16 | Normal |
| | Matte Photographic Paper | Fast | 16 | 1-16 | Normal |
| | | Pretty | 32 | 1-32 | Normal |
| Cloth Printing Mode | Synthetic Fibers | Fast | 4 | 1-4 | High |
| | | Pretty | 16 | 1-16 | High |
| | Natural Fibers | Fast | 4 | 1-4 | High |
| | | Pretty | 16 | 1-8 | High |
| | | | | 9-16 | Normal |

Fig. 3A

| Printing Mode | Type Of Print Quality | Resolution (dpi) |
|---|---|---|
| Plain Paper Printing Mode | Fast | 300 x 300 |
| | Pretty | 600 x 600 |
| Photographic Printing Mode | Fast | 600 x 600 |
| | Pretty | 1200 x 1200 |
| Cloth Printing Mode | Fast | 300 x 300 |
| | Pretty | 600 x 600 |

Fig. 3B

<SURFACE ROUGHNESS>

| TYPE OF PRINT MEDIUM | GENERAL SURFACE ROUGHNESS (Sa) (x10) | SURFACE ROUGHNESS * (Sa) (x10) | SURFACE WAVING * (Wa) (x10) |
|---|---|---|---|
| PLAIN PAPER | 2.48 μm | 1.56 μm | 1.65 μm |
| RECYCLED PAPER | 2.75 μm | 1.41 μm | 1.97 μm |
| FINE PAPER | 3.86 μm | 1.96 μm | 2.78 μm |
| PHOTO PAPER | 0.09 μm | 0.03 μm | 0.05 μm |
| GLOSSY PHOTO PAPER | 0.19 μm | 0.09 μm | 0.14 μm |
| MATTE PHOTO PAPER | 0.08 μm | 0.08 μm | 0.05 μm |
| COATED PAPER | 0.14 μm | 0.05 μm | 0.07 μm |
| GLOSSY PHOTOGRAPH PAPER | 0.32 μm | 0.07 μm | 0.27 μm |
| MATTE PHOTOGRAPH PAPER | 0.65 μm | 0.07 μm | 0.48 μm |
| SYNTHETIC FIBERS | 1.37 μm | 1.04 μm | 1.65 μm |
| NATURAL FIBERS | 3.85 μm | 2.86 μm | 1.84 μm |

* CUT-OFF LENGTH: 50 μm

Fig. 4

| PASS NUMBER | 1 | 2 | 3 | 4 |
|---|---|---|---|---|
| ADVANCE AMOUNT L (dot) | 0 | 4 | 4 | 4 |
| ΣL | 0 | 4 | 8 | 12 |
| F=(ΣL)%k | 0 | 1 | 2 | 0 |

PRINTING APPARATUS AND CONTROL METHOD AND PROGRAM THEREOF

CROSS-REFERENCE TO RELATED APPLICATIONS

This application claims priority to Japanese Patent Application No. 2014-044566 filed on Mar. 7, 2014. The entire disclosure of Japanese Patent Application No. 2014-044566 is hereby incorporated herein by reference.

BACKGROUND

1. Technical Field

The present invention relates to a printing apparatus and a control method and program for the printing apparatus.

2. Related Art

A known use of piezoelectric elements is in printing apparatus that ejects ink droplets for images, documents, and the like. The piezoelectric elements are arranged to correspond respectively to a plurality of nozzles in a head unit, and each is driven to follow a drive signal to eject ink droplets onto a print medium from the nozzles at predetermined timings.

The technique that is applied to this type of printing apparatus, for example, is a technique in which the position of the meniscus of the ink droplet during a wiping operation is drawn into the nozzle compared to the position of the meniscus of the ink droplets during the printing process (see JP-A-2009-178867 (Patent Document 1)), a technique that waits until the position of the meniscus during no ejection of ink is near the connection position of an individual collection flow path in order to prevent thickening of ink in the nozzle (see JP-A-2010-194750 (Patent Document 2)), and a technique that selects either a state in which the back pressure of the nozzle liquid surface during wiping is much greater than atmospheric pressure or a state in which the back pressure is less than atmospheric pressure (see JP-A-2011-161828 (Patent Document 3)).

SUMMARY

Recently, however, there has been the desire for printing apparatus to handle various types of print media. Among these print media, the surfaces thereof are, for example, extremely smooth types such as glossy photographic paper and rough types such as Japanese paper. Because the printing is on print media having this type of rough surface, plainly speaking, print media with the nap of composite fibers, when the head unit is scanned, the tips of the composite fibers touch the tips of the nozzles and are transmitted to the print medium, which indicates the possibility of soiling the print medium.

An advantage of several embodiments of the present invention is to provide a printing apparatus that reduces the risk of the print medium from being soiled by ink, and a control method and programs for the printing apparatus even for when printing on print media having a rough surface.

To achieve the objective described above, a printing apparatus includes a piezoelectric element configured to be displaced in response to voltage of a drive signal; a cavity in which ink is filled, and whose internal volume is increased or decreased by displacement of the piezoelectric element; a nozzle connected to the cavity and configured to eject the ink as ink droplets onto a print medium by increasing or decreasing of the internal volume of the cavity; a printing mode receiver configured to receive selection of at least one photographic paper printing mode for printing onto photographic paper and at least two plain paper printing modes for printing onto plain paper from among printing modes; and a control unit configured to control a meniscus position in the nozzle to be separated further from an orifice surface of the nozzle when the selection of one plain paper printing mode from among the at least two plain paper printing modes is received by the printing mode receiver than when the selection of the photographic paper printing mode is received.

When plain paper and photographic paper are compared as the print media, plain paper has a greater surface roughness and wrinkles more easily. According to a printing apparatus related to the above embodiment, when a selection of one plain paper printing mode was received, the meniscus position in the nozzle is drawn to the cavity side to separate further from the orifice surface of the nozzle than when a selection of the photographic paper printing mode was received. Therefore, there is reduced risk of the fibers of the paper coming into contact with the ink held in the nozzle and transmitting ink to the print medium through the fibers (through capillary action).

The position of the meniscus in the nozzle is the position of the interface between a droplet and the air in the nozzle that is not ejecting ink droplets. The position of the meniscus in the nozzle is considered to vary over time, and, for example, is referred to as the average position in a unit time period.

In the printing apparatus related to the embodiment described above, printing is executed in a plurality of passes in the plain paper printing mode. The control unit may also be configured to control the meniscus position of the nozzle in an initial pass to be further separated from the orifice surface of the nozzle than the meniscus position of the nozzle in a final pass.

According to this configuration, even when a plurality of ink droplets is ejected at the same point or at nearby points over a plurality of passes, the position of the meniscus in the final pass is temporarily separated further from the orifice surface of the nozzle than in the initial pass. Therefore, the risk of soiling the print medium is reduced even if fibers infiltrate the nozzle by so-called cockling.

In a printing apparatus related to the embodiment described above, the control unit may be configured to have a printing mode that executes printing in a plurality of passes, and that controls the meniscus position of the nozzle in a final pass to be separated further from the orifice surface of the nozzle than the meniscus position of the nozzle in an initial pass.

For example, compared to paper, natural fibers such as cotton and silk have nap on their surfaces. According to this structure, because the position of the meniscus in the initial pass is temporarily separated further from the orifice surface of the nozzle than in the final pass, the risk is reduced of the print media being soiled by fibers infiltrating the nozzle. For cloth, the material thereof functions as an ink receiving level and absorbs ink ejected from the nozzle. Therefore, even if the initial surface is napped, the nap is suppressed by the repeated ejection of ink droplets in a plurality of passes. Therefore, even if the position of the meniscus of the nozzle in the final pass is close to the orifice surface of the nozzle, the possibility of fibers infiltrating the nozzle is low.

The present invention can be implemented in various embodiments. For example, implementation is possible in various embodiments, such as a control method of a printing apparatus, a print control apparatus, programs for executing these methods or the functions of the apparatus on a computer connected to the printing apparatus, and recording media readable by the computer storing the programs.

BRIEF DESCRIPTION OF THE DRAWINGS

Referring now to the attached drawings which form a part of this original disclosure:

FIGS. 3A and 3B are diagrams showing examples of the contents of a printing mode table;

FIG. 4 is a diagram showing the surface roughness of each print medium;

DETAILED DESCRIPTION OF EMBODIMENTS

Figure 1:
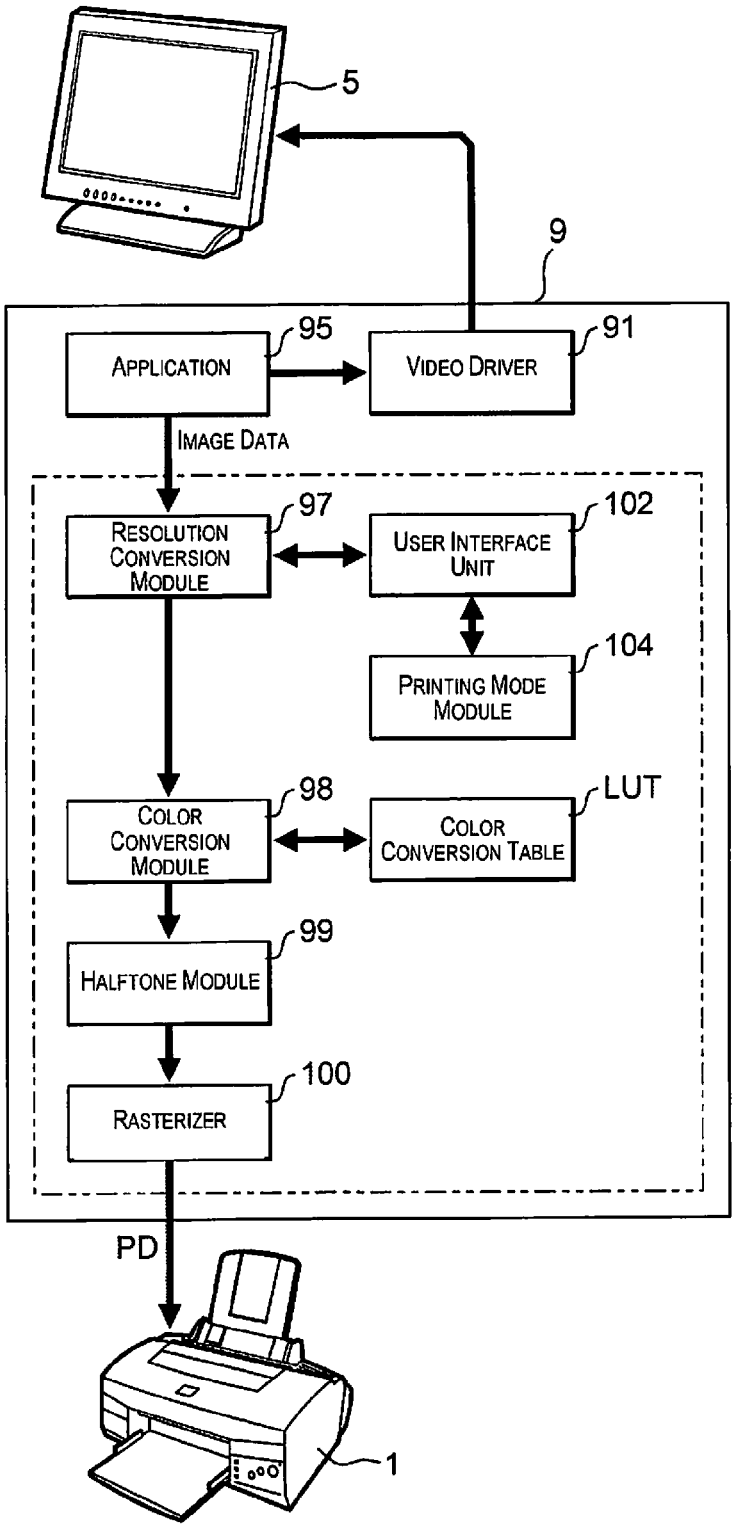
FIG. 1 is a block diagram showing the configuration of a printing system as one embodiment.

FIG. 1 is a block diagram showing the configuration of a printing system as an embodiment of the present invention. This printing system is provided with a computer 9 as the printing control apparatus and a color printer 1 as the printing unit. The combination of the color printer 1 and the computer 9 is sometimes broadly referred to as the "printing apparatus."

In the computer 9, an application program 95 operates under a predetermined operating system. A video driver 91 and a printer driver 96 are combined in the operating system. Print data PD for transporting to the color printer 1 are output by the application program 95 via these drivers. The application program 95 executes the desired processing on the image to be processed and displays the image on a display unit 5 via the video driver 91.

When the application program 95 issues a print command, the printer driver 96 of the computer 9 receives image data from the application program 95 and transforms the data into print data PD to be supplied to the color printer 1.

In the example shown in FIG. 1, a resolution conversion module 97, a color conversion module 98, a halftone module 99, a rasterizer 100, and a color conversion table LUT are provided inside of the printer driver 96.

The resolution conversion module 97 plays the role of converting the resolution of the color image data (namely, number of pixels per unit length) that is handled by the application program 95 into a resolution that can be handled by the printer driver 96. The image data that underwent resolution conversion are the image information comprised of the three colors of red, green, and blue (RGB). The color conversion module 98 converts the RGB image data of each pixel into multilevel data of a plurality of ink colors that are available in the color printer 1 while referring to the color conversion table LUT.

The color-converted multilevel data have, for example, grayscale values for 256 levels. The halftone module 99 executes a halftone process to represent these grayscale values in the color printer 1 by dispersing ink dots. The image data that underwent halftone processing are rearranged in the order in which the data should be transferred to the color printer 1 by the rasterizer 100 and output as the final print data PD.

Print data PD include raster data showing the recording state of the dots during each main scan and data showing the advance amount in the auxiliary scan.

Here, the printer driver 96 corresponds to a program for implementing the function that generates the print data PD. The program for implementing the function of the printer driver 96 is supplied from a recording medium readable by computer or by downloading from a specific site over the Internet (not shown). The recording media may be various media such as flexible disks, CD-ROMs, opto-magnetic disks, and IC cards.

Figure 2:
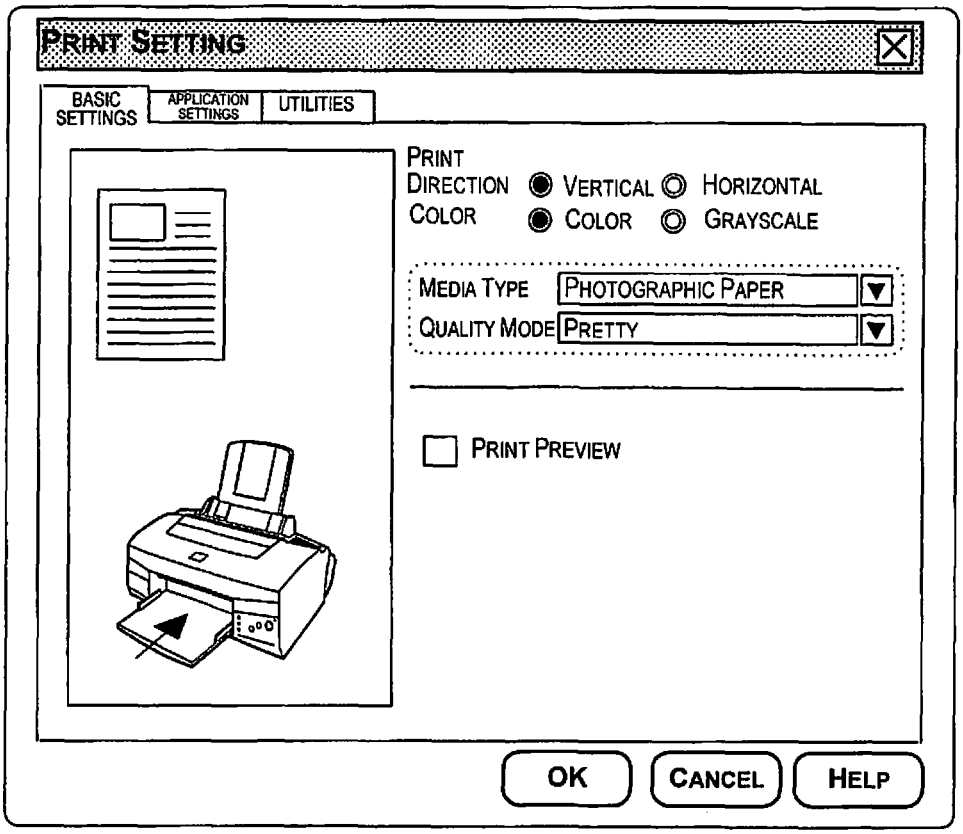
FIG. 2 is a diagram showing a printing condition setting window that is displayed on a display unit.

FIG. 2 is an explanatory diagram showing a printing condition setting window (a so-called printer control panel) that is displayed on the display unit 5 of the computer 9 by a user interface unit 102 of the printer driver 96.

The user (operator) can individually select the type of print medium and the type of print quality as the basic settings of the printing conditions via the printing condition setting window. Therefore, in this embodiment, the display unit 5 that displays the printing condition setting window functions as the printing mode receiver, but the configuration may set up the display unit that displays the printing condition setting window in the body of the color printer 1 to set the printing conditions.

The various print media are plain paper, photographic paper, and cloth. For example, when the user selects plain paper from a pull-down menu, plain paper can have further subdivisions to select from.

In addition, the print quality is, for example, "Fast" and "Pretty," similarly, can be selected from a pull-down menu. "Fast" is a mode that gives precedence to the printing speed and is used when the time required for printing is short. "Pretty" is the mode that gives precedence to placing resolution above "Fast," the finish of the printing, and the visual appeal.

In addition, the size of the print media, color/monochrome, and the number of printed copies can be specified in the printing condition setting window; however, these are omitted from FIG. 2.

FIGS. 3A and 3B are diagrams showing examples of the content of a printing mode table 104 registered in the printer driver 96.

In the color printer printing mode table 104, the type of print media and the type of print quality are assumed to be as shown in FIG. 3A in the printing condition setting window (see FIG. 2). Specifically, as shown in FIG. 3A, there is assumed to be a total of 11 types of print media: 3 types of plain paper, 6 types of photographic paper, and 2 types of cloth. The types of print quality for each type are assumed to be "Fast" that gives precedence to the printing speed and "Pretty" that gives precedence to the finish.

Then, when the type of print media and the type of print quality are selected in the printing condition setting window, the configuration sets the number of overlaps and the meniscus mode in lap units in response to the combination of selections.

Here, for example, when "Recycled paper" is selected as the print medium and "Pretty" is selected as the print quality, the number of overlaps is set to "4," the meniscus mode in the first and second laps is set to the "Normal (position)," and the meniscus mode in the third and fourth laps is set to the "High (position)." For example, when "Coated paper" is selected as the print medium, and "Pretty" is selected as the print quality, the number of overlaps is set to "8," and the meniscus modes in the first to the eighth laps are set to the "Normal (position)." The lap unit is the number of the lap when the number of overlaps is a plural number, and for convenience, the lap number is set to "1" even when the number of overlaps is the singular number "1." The number of overlaps and the meniscus mode will be explained later.

In addition, the printing mode table 104 is configured to determine the printing mode in response to the type of the selected print medium. Specifically, the printing modes are the "Plain paper printing mode," "Photographic paper printing mode," and "Cloth printing mode." For example, when "Recycled paper" is selected as the type of print medium, the "Plain paper printing mode" is set as the printing mode. For example, when "Glossy photographic paper" is selected as the type of print medium, the "Photographic paper printing mode" is selected as the printing mode.

Then, as shown in FIG. 3B, the printing resolution is set to correspond to the types of the printing mode and the print quality.

For example, when "Pretty" is selected as the print quality when "Recycled paper" is selected as the print medium, and the printing mode becomes the "Plain paper printing mode," the resolution is set to 600×600 [dpi]. In another example, when "Pretty" is selected as the print quality when "Glossy photographic paper" is selected as the print medium and the printing mode becomes the "Photographic paper printing mode," the resolution is set to 1200×1200 [dpi].

The resolution is displayed as (Resolution in the main scanning direction)×(Resolution in the auxiliary scanning direction) and will be explained later in detail. Generally, the printing speed is faster as the number of scan repetitions (to be described later) decreases and is faster as the printing resolution is reduced.

FIG. 4 is a table that indicates the surface characteristics of each type of print media in the printing mode table 104, specifically, the arithmetical mean values of the total surface roughness, the surface roughness, and the surface waviness.

Broadly speaking, photo paper, glossy photo paper, matte photo paper, coated paper, glossy photographic paper, matte photographic paper (hereinafter, referred to as "photographic paper") suppress surface roughness and waviness to low levels more than plain paper, recycled paper, and fine paper (hereinafter, referred to as "recycled paper and the like").

The terms, the definitions, and the surface characteristic parameters for representing the surface characteristics (roughness profile, waviness profile, and cross-section profile) are stipulated in JIS B 0601.

Figure 5:
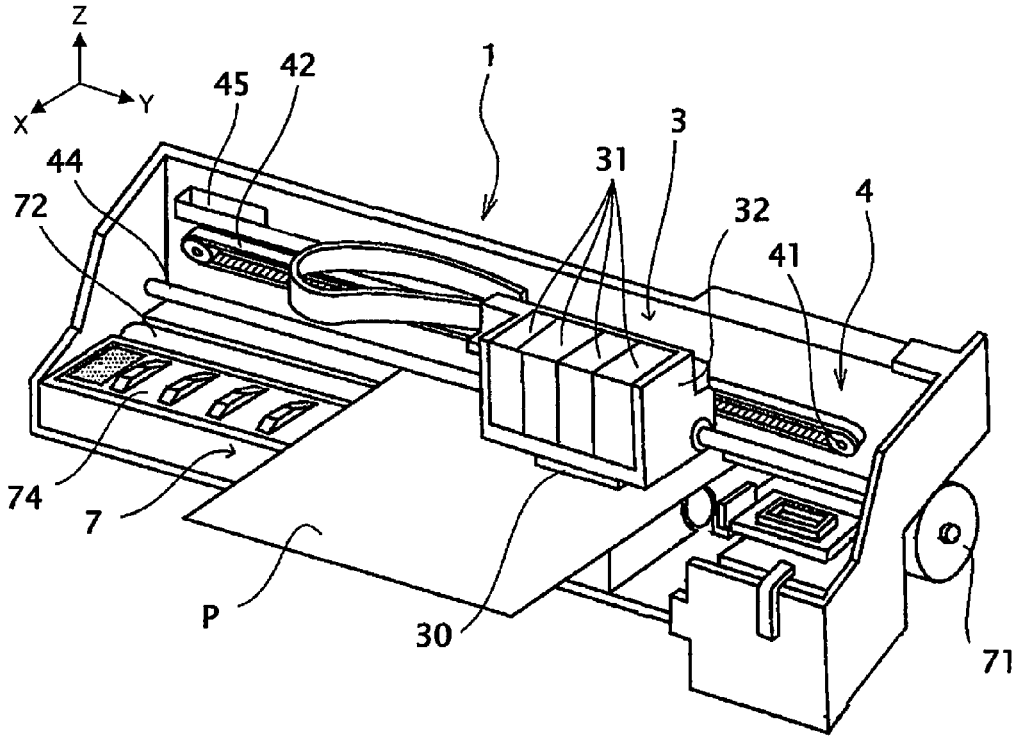
FIG. 5 is a diagram showing the configuration of the interior of a color printer.

FIG. 5 is a perspective diagram showing the overall configuration of the inside of the color printer 1.

As shown in this drawing, the color printer 1 is provided with a motion mechanism 4 that moves a mobile body 3 in the main scanning direction (reciprocating motion), which is the direction of the Y-axis in the drawing.

The motion mechanism 4 has a carriage motor 41 that becomes the drive source of the mobile body 3, a carriage guide shaft 44 fixed to both ends thereof, a timing belt 42 that extends nearly parallel to the carriage guide shaft 44 and is driven by the carriage motor 41, and a carriage motor driver (to be described later) for driving the carriage motor 41.

A carriage 32 of the mobile body 3 is supported to enable reciprocating motion on the carriage guide shaft 44 of the motion mechanism 4 and is fixed to one part of the timing belt 42. Therefore, when the timing belt 42 is scanned forward and in reverse by the carriage motor 41, the mobile body 3 is guided by the carriage guide shaft 44 in reciprocating motion.

A scale 45 prints a stripe pattern at the specified interval along the main scanning direction, and a photo interpreter composed of a light-emitting element and a light-receiving element pair is provided on the side opposite the scale 45 in the carriage 32. This photo interpreter is configured to enable detection of the position in the main scanning direction (Y-axis direction) of the carriage 32 by reading the stripe pattern. The pattern of the scale 45 and the photo interpreter are omitted from the drawings.

The color printer 1 is provided with a transport mechanism 7 that transports a print medium P on a platen 74 in the auxiliary scanning direction, which is the direction of the X-axis in the drawings. The transport mechanism 7 is provided with a transport motor 71 that is the drive source, a transport motor driver (to be described later) for driving the transport motor 71, and a transport roller 72 that is rotated by the transport motor 71 and transports the print medium P in the auxiliary scanning direction.

An image is formed on the surface of the print medium P by ejecting ink droplets (liquid drops) onto the print medium P at the timing at which the print medium P is transported by the transport mechanism 7.

Figure 6:
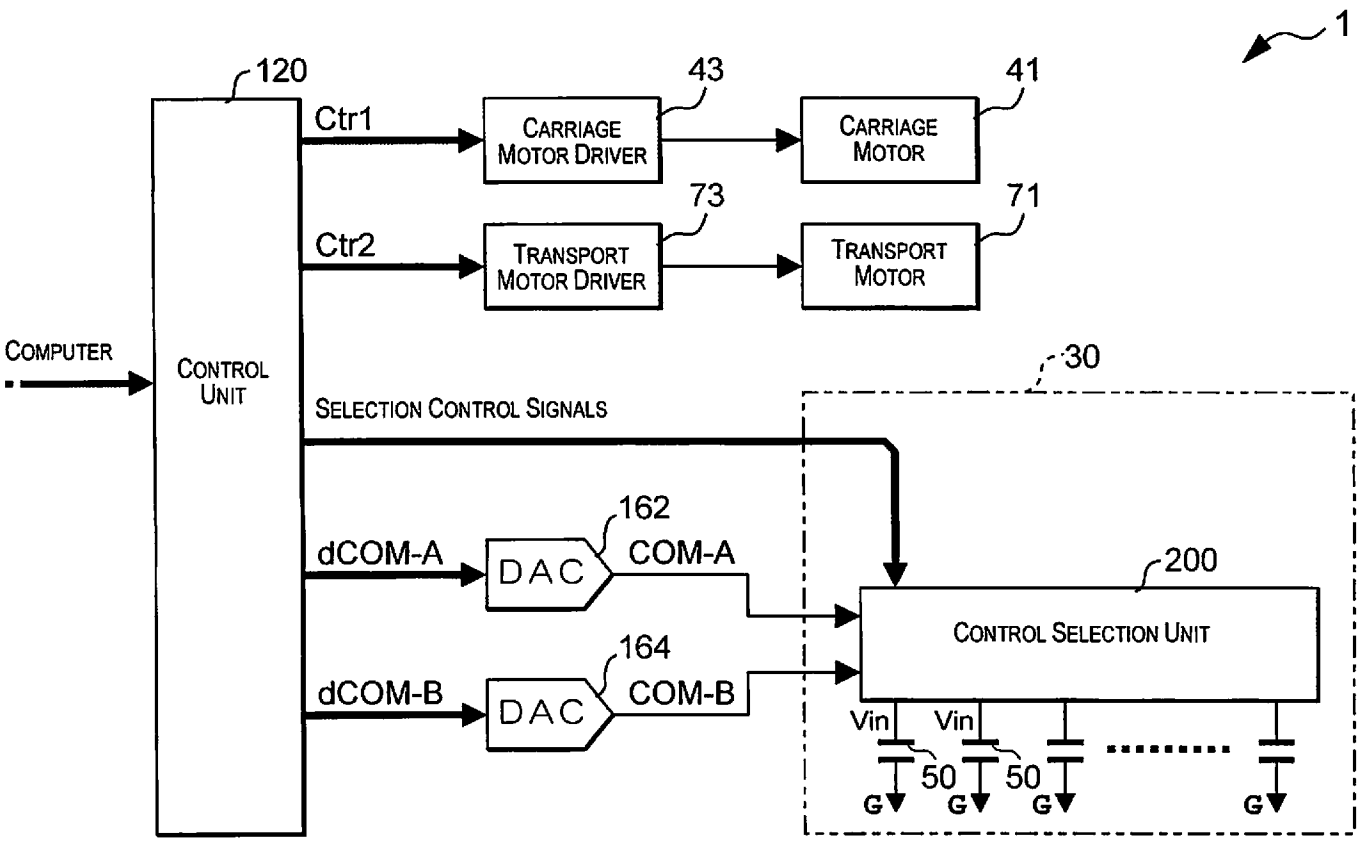
FIG. 6 is a block diagram showing the electrical configuration of a color printer.

FIG. 6 is a block diagram showing the electrical configuration of the color printer 1.

As shown in this drawing, the color printer 1 includes a control unit 120; a carriage motor 41; a carriage motor driver 43; a transport motor 71; a transport motor driver 73; digital-to-analog converters (DACs) 162, 164; and a head unit 30.

The control unit 120 outputs a plurality of types of signals to control each unit in accordance with the print data PD output from the computer 9. The print data PD are stored temporarily in a buffer (omitted from the drawing).

A plurality of types of signals output by the control unit 120 includes digital control data dCOM-A supplied to the DAC 162, digital control data dCOM-B supplied to the DAC 164, and selection control signals that are supplied to a selection control unit 200 to be described later.

The color printer 1 includes a carriage motor 41 that moves the carriage 32 mounted with a head unit 30 in the main scanning direction and a carriage motor driver 43 for driving the carriage motor 41.

To control the motion in the main scanning direction in the carriage 32, the control unit 120 supplies a control signal Ctr1 to the carriage motor driver 43. The carriage motor driver 43 drives the carriage motor 41 in accordance with the control signal Ctr1. Although omitted from FIG. 6, the information of the scale 45 read by the photo interpreter from the head unit 30, that is, the information indicating the position in the main scanning direction of the carriage 32, is fed back to the control unit 120; and the motion in the main scanning direction in the carriage 32 is controlled by the control unit 120.

The control unit 120 supplies a control signal Ctr2 to the transport motor driver 73 to control the motion in the auxiliary scanning direction by the transport mechanism 7. The transport motor driver 73 drives the transport motor 71 in accordance with the control signal Ctr2.

DAC 162 converts control data dCOM-A into analog drive signal COM-A and supplies the signal to the head unit 30. Similarly, DAC 164 converts control data dCOM-B into analog drive signal COM-B and supplies the signal to the head unit 30. In practice, drive signals COM-A, COM-B after output from DACs 162, 164, respectively, are amplified and supplied to the head unit 30.

A selection control unit 200 and a plurality of piezoelectric elements 50 are provided in the head unit 30.

The selection control unit 200 selects either one of the drive signals COM-A, COM-B in accordance with the selection control signal supplied from the control unit 120 and supplies the signal as the drive signal Vin to one terminal of the piezoelectric elements 50. In other words, each of the piezoelectric elements 50 is configured to be driven by the drive signal Vin of either of the drive signals COM-A, COM-B selected by the selection control unit 200.

In this example, the other terminals of the piezoelectric elements 50 are connected to a common ground G having a voltage of zero.

As described above, the piezoelectric elements 50 are set to correspond to each of a plurality of nozzles in the head unit 30 and eject liquid droplets by this drive. Next, the configuration of the ejection unit for ejecting the liquid droplets by the drive of the piezoelectric elements 50 is explained.

Figure 7:
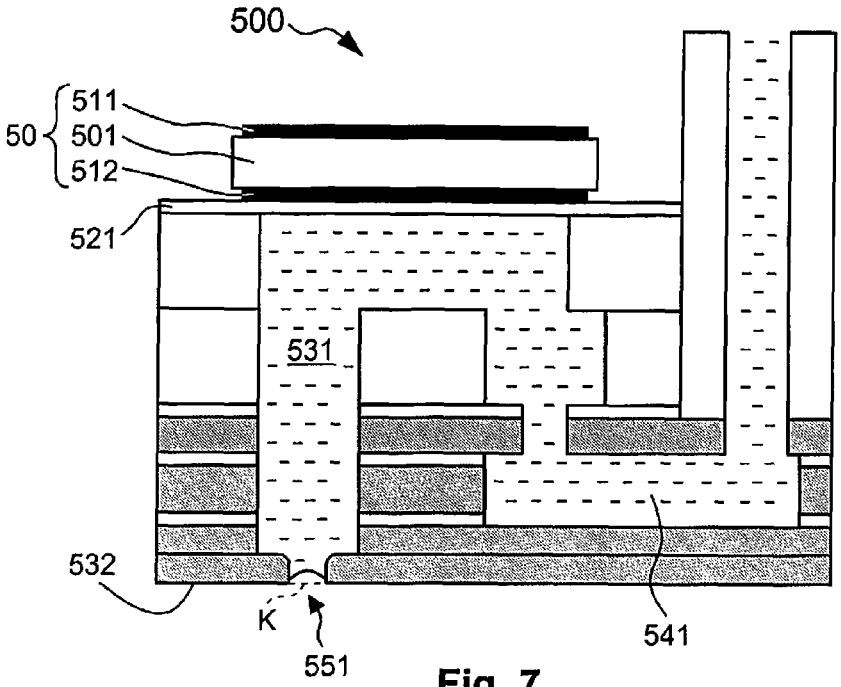
FIG. 7 is a diagram showing the configuration of an ejection unit in a color printer.

FIG. 7 is a diagram showing the overall structure of the ejection unit corresponding to each nozzle in the head unit 30.

As shown in the diagram, an ejection unit 500 includes a piezoelectric element 50, an oscillation plate 521, a cavity (pressure chamber) 531, a reservoir 541, and a nozzle 551. Of these, the oscillation plate 521 is deformed by the piezoelectric elements 50 provided in the top part of the drawing and functions as a diaphragm that expands and contracts the internal volume of the cavity 531 that is filled with ink. The nozzle 551 is provided in a nozzle plate 532 and is connected to the cavity 531.

The nozzle plate 532 has the positional relationship of being opposite to the print medium (omitted from FIG. 7) in the lower part of FIG. 7. The orifice part of the nozzle 551 is the virtual surface where the nozzle 551 is positioned on the nozzle plate 532, namely the orifice surface K indicated by the dashed line in the drawing.

The piezoelectric elements 50 shown in the drawing generally refer to a unimorph (monomorph) type that is configured to sandwich a piezoelectric body 501 between a pair of electrodes 511, 512. In the piezoelectric body 501 in this structure, the electrodes 511, 512, and the oscillating plate 521, and the center part in the drawing bend in the vertical direction with respect to both end parts in response to the voltage applied between the electrodes 511, 512, namely the voltage of the drive signal Vin (bending oscillation mode). Specifically, the piezoelectric element 50 is configured to bend in the upward direction if the voltage of the drive signal Vin is lower and to bend in the downward direction if higher.

However, this drawing shows the flat state without bending in the vertical direction. In this state, ink fills the reservoir 541 and the cavity 531, and the position of the meniscus (i.e., the interface between the ink and the air) in the nozzle 551 is held as shown in the drawing.

Figure 10:
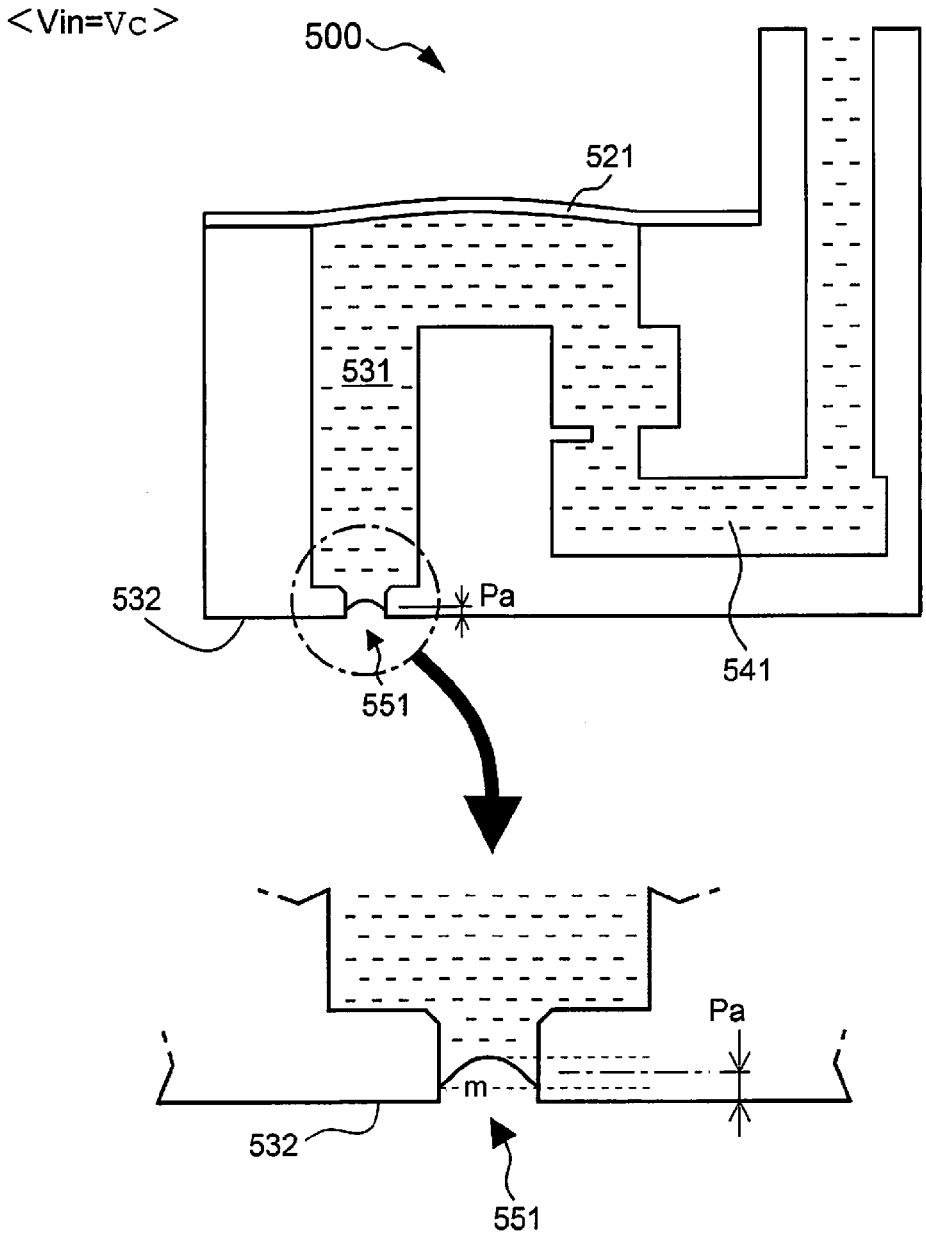
FIG. 10 is a diagram for explaining the position of the meniscus of the nozzle.

As shown in FIG. 10, a meniscus m is curved by the surface tension of the ink. Therefore, the position of the meniscus in some gap is shown as shown in the drawing is the mean value of the meniscus curve (dashed line). Other than the mean value, a method for specifying the meniscus position may be, for example, the ink (the upper surface of the convexity).

The piezoelectric element 50 in FIG. 7 is not limited to the bending oscillation mode and may be configured to use the longitudinal oscillation mode.

Figure 8:
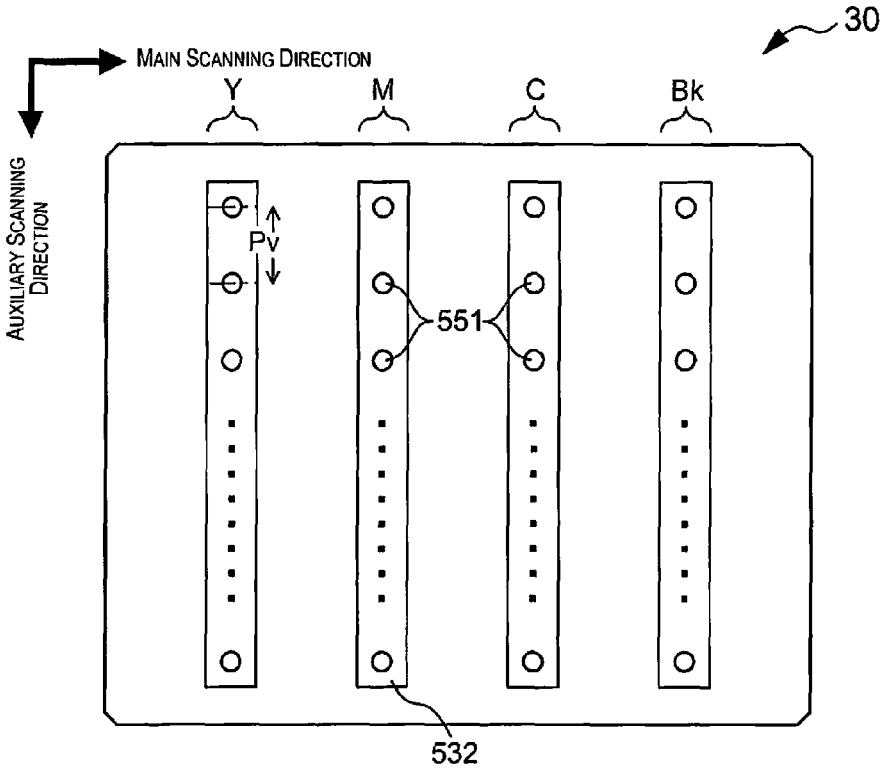
FIG. 8 is a diagram showing an example of a nozzle array in a head unit in a color printer.

FIG. 8 is a diagram showing an example of a nozzle array on the lower surface of the head unit 30, that is, the nozzle plate 532.

The nozzles 551 are broadly divided into nozzle group (Y) for ejecting yellow ink, nozzle group (M) for ejecting magenta ink, nozzle group (C) for ejecting cyan ink, and nozzle group (Bk) for ejecting black ink.

In each nozzle group, a plurality of nozzles 551 is arranged at a constant pitch Pv (=k·D) along the auxiliary scanning direction. Here, k is an integer, and D is the pitch (referred to as the "dot pitch") corresponding to the printing resolution in the auxiliary scanning direction. In other words, a plurality of nozzles 551 is arranged at k times the interval for the dot pitch D corresponding to the printing resolution in the auxiliary scanning direction.

Each nozzle group does not need to be arranged in a straight line along the auxiliary scanning direction and, for example, may be arranged with a half pitch shift between two rows (zigzag array). When the nozzles are in a zigzag array, the nozzle pitch Pv (k·D) along the auxiliary scanning direction can be defined similar to the case in FIG. 8.

Figure 9:
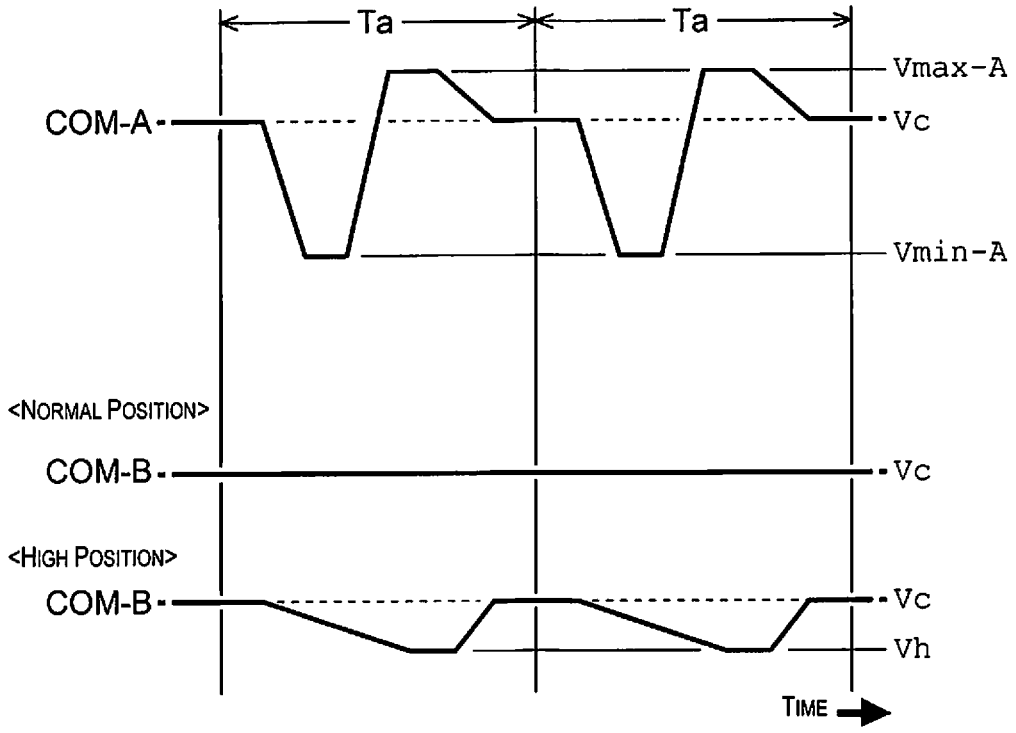
FIG. 9 is a diagram showing an example of the drive signals COM-A, COM-B.

FIG. 9 is an example showing the waveforms of the drive signals COM-A, COM-B when the head unit 30 moves in the main scanning direction.

In this drawing, drive signal COM-A is a voltage pattern having period Ta for ejecting ink droplets. In contrast, drive signal COM-B is a voltage pattern that does not eject ink droplets. The two types of the meniscus mode are "Normal" and "High."

For drive signal COM-B, the "Normal" meniscus mode has a constant voltage Vc, and "High" has the voltage pattern with period Ta.

In the piezoelectric element 50, either one of the drive signals COM-A, COM-B is selected by the selection control unit 200 at each period Ta and supplied as the drive signal Vin. Therefore, the drive signals COM-A, COM-B are explained respectively in relation to the behavior of the piezoelectric element 50 when supplied as the drive signal Vin.

First, the behavior is explained when the drive signal COM-A is supplied to a piezoelectric element 50.

Figure 13:
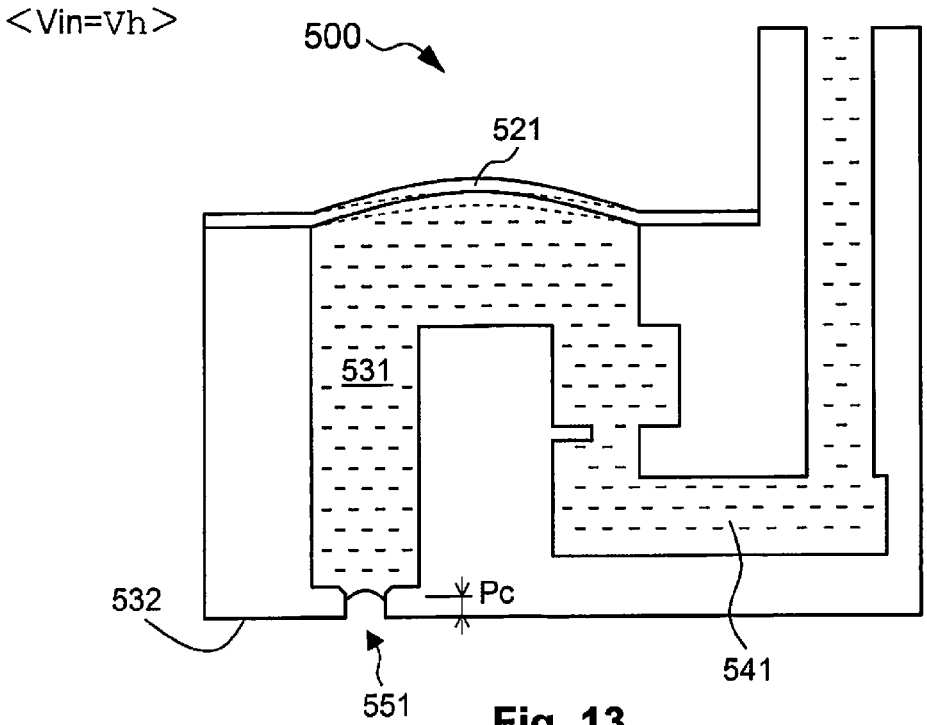
FIG. 13 is a diagram for explaining the position of the meniscus of the nozzle.

As shown in FIG. 9, the drive signal COM-A is the voltage Vc at the start of period Ta. In the state in which the voltage Vc was applied, the center part bends slightly in the upward direction with respect to both end parts with reference to the state shown in FIG. 7. Therefore, the oscillation plate 521 bends slightly upward as shown in FIG. 10. In FIG. 10 (to FIG. 13), to simplify the explanation, the piezoelectric element 50 is omitted in the explanation and replaced by the deformation of the oscillation plate 521.

When the oscillation plate 521 bends slightly upward, the volume of the cavity 531 expands slightly. The meniscus m of the nozzle 551 is drawn slightly to the cavity 531 side and becomes the point separated by only the distance Pa from the surface of the nozzle plate 532.

Figure 11:
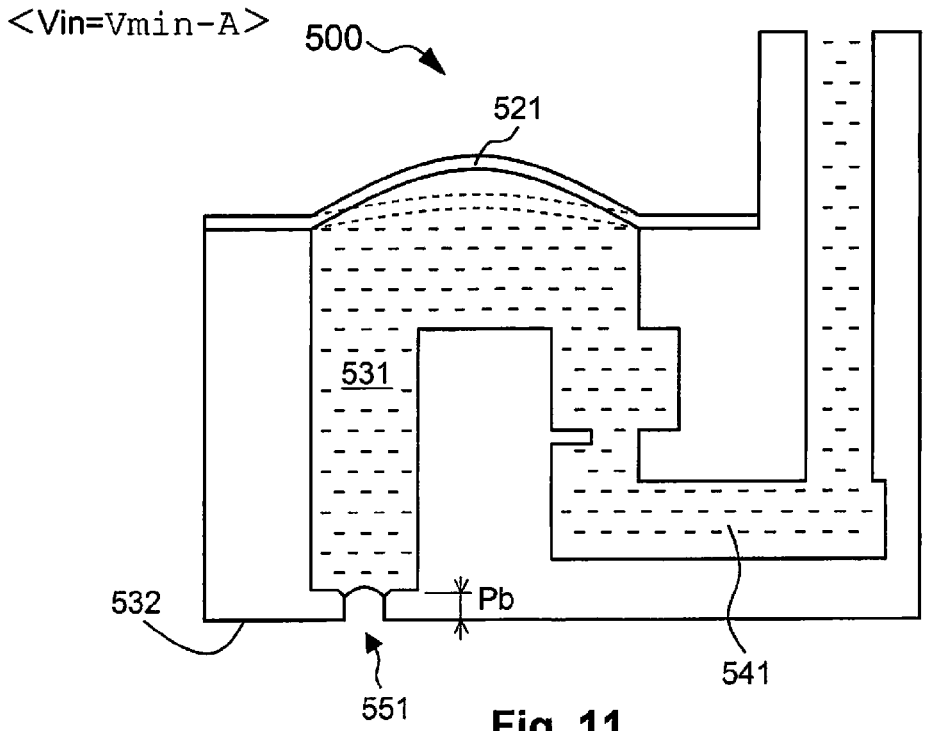
FIG. 11 is a diagram for explaining the position of the meniscus of the nozzle.
Figure 12:
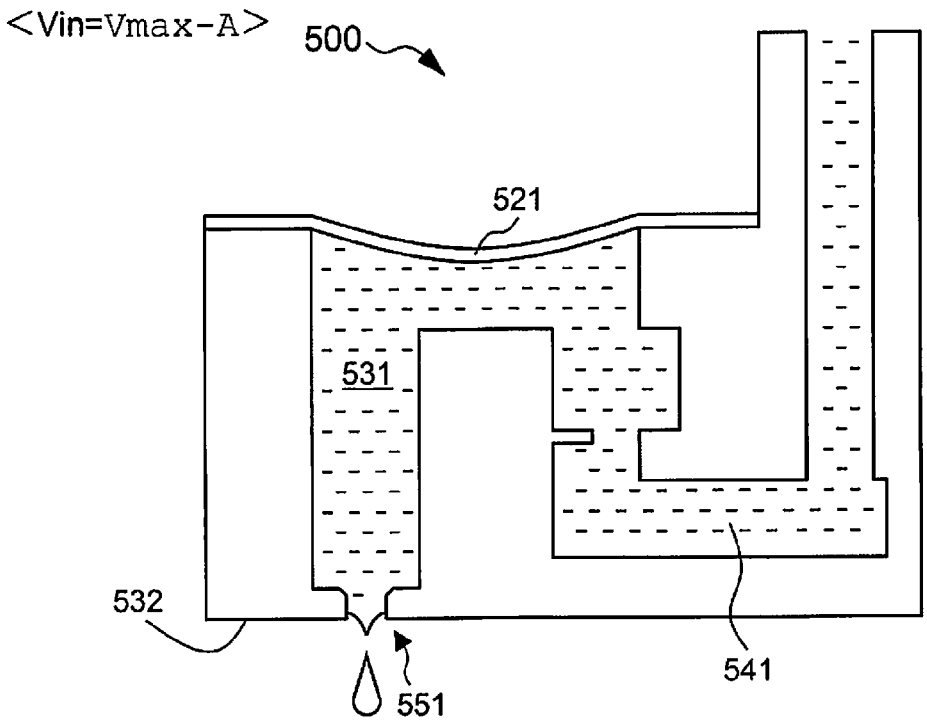
FIG. 12 is a diagram for explaining the position of the meniscus of the nozzle.

When drive signal COM-A is converted from voltage Vc to voltage Vmin-A, the oscillation plate 521 and the center part of the piezoelectric element 50 bend in the upward direction with respect to both end parts. Therefore, as shown in FIG. 11, the volume of the cavity 531 expands, and ink is drawn in from the reservoir 541.

In addition, the position of the meniscus in the nozzle 551 is drawn temporarily to the cavity 531 side, for example, to the point at distance Pb, accompanying the expansion of the volume of the cavity 531 by the conversion to the voltage Vmin-A.

When drive signal COM-A (Vin) is converted from voltage Vmin-A to voltage Vmax-A, the center part of the piezoelectric element 50 and the oscillation plate 521 bend downward with respect to the two end parts. Therefore, as shown in FIG.

12, the volume of the cavity 531 is reduced substantially and ink is ejected from the nozzle 551.

When drive signal COM-A (Vin) is converted from voltage Vmax-A to voltage Vc, the piezoelectric element 50 returns to the state shown in FIG. 10. Therefore, the position of the meniscus in the nozzle 551 returns to the point separated by only the distance Pa from the surface of the nozzle plate 532.

When this kind of voltage pattern of the drive signal COM-A is supplied to the piezoelectric elements 50 of the ejection unit 500 as the drive signal Vin, ink droplets are ejected from the nozzles 551 of the ejection unit 500.

Figure 14:
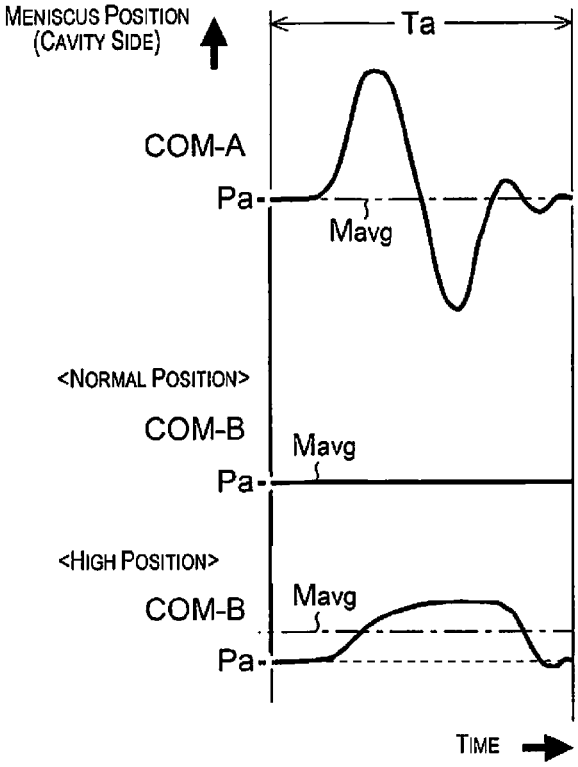
FIG. 14 is a diagram showing temporal changes in the position of the meniscus.

The position of the meniscus m of the nozzle that ejects ink droplets actually oscillates between the cavity 531 side (top side in the drawing) and the print medium P side (bottom side in the drawing) over the period Ta as shown in the top part of FIG. 14. However, the average position Mavg over the period Ta is close to the position when the drive signal Vin is approximately voltage Vc, namely to the point separated by only the distance Pa from the surface of the nozzle plate 532.

Next, for drive signal COM-B, the behavior of the ejection unit 500 is explained when the voltage pattern for the "High" meniscus mode is supplied to the piezoelectric elements 50.

The drive signal COM-B corresponding to the "High" meniscus mode is voltage Vc at the start of period Ta. Therefore, similar to drive signal COM-A, when voltage Vc is applied, the position of the meniscus m in the nozzle 551 becomes the point separated by only the distance Pa from the surface of the nozzle plate 532.

When drive signal COM-B is converted from voltage Vc to voltage Vh (<Vc), the oscillation plate 521 and the center part of the piezoelectric element 50 bend upward with respect to the two end parts. Since Vh>Vmin-A, the amount of bending of the piezoelectric element 50 is small compared to drive signal COM-A. Therefore, as shown in FIG. 11, the position of the meniscus m in the nozzle 551 is drawn to the cavity 531 side at distance Pc (<Pb).

When drive signal COM-B (Vin) is converted from voltage Vh to voltage Vc, because the piezoelectric element 50 returns to the state shown in FIG. 10, the position of the meniscus m of the nozzle 551 returns to the point separated by only distance Pa from the surface of the nozzle plate 532. At this time, ink droplets are not ejected from the nozzle 551.

Compared to when ink droplets are ejected, when ink droplets are not ejected, the position of the meniscus m hardly moves at all to the print medium P side, that is the spraying side, and the time to draw to the cavity 531 side lengthens. Therefore, when viewed at the average position Mavg over period Ta, compared to when ink droplets are ejected, the position of the meniscus m when ink droplets are not ejected is drawn to the cavity 531 side as shown in the lower part of FIG. 14.

Because drive signal COM-B for the "Normal" meniscus mode is constant at voltage Vc, the position of the meniscus m at the nozzle 551, even when viewed as the average position Mavg over period Ta, becomes constant at the point separated by only distance Pa from the surface of the nozzle plate 532 as shown in the center part of FIG. 14.

Thus, in the nozzles 551 of the ejection unit 500 that includes piezoelectric elements 50 to which the drive signal COM-B for the "High" meniscus mode is supplied, the position of the meniscus m is separated further from the orifice surface K of the nozzle 551, in other words, is drawn to the cavity 531 side, than when supplied the drive signal corresponding to the "Normal" meniscus mode.

Here, the selection control unit 200 selects and supplies either the drive signal COM-A or the drive signal COM-B for a plurality of piezoelectric elements 50.

In this embodiment, the nozzles 551 in the head unit 30 are arranged as shown in FIG. 8. Therefore, when the head unit 30 moves in the main scanning direction, and when ink droplets are ejected or not ejected at some point, before reaching the current point, the selection control unit 200 is configured so that data on whether or not to form a dot at the current point are latched for the number of nozzles, and when the head unit 30 reaches the current point, one of drive signal COM-A and drive signal COM-B is selected based on the latched data and supplied to each nozzle.

Then, the head unit 30 moves to the next point separated by only the dot interval D from the current point (namely, until period Ta of drive signal COM-A, COM-B has elapsed), data on whether or not to form a dot at the next point are latched for the number of nozzles. Selection control unit 200 repeats the latching and selecting.

The drive signals COM-A, COM-B shown in FIG. 9 are one example for the explanation. In practice, the voltage patterns for a large dot, an intermediate-sized dot, and a small dot are sometimes combined to form one period in drive signals COM-A, COM-B.

Next, a recording method for the color printer 1 in the embodiment is first explained for an interlaced recording method.

The "interlaced recording method" is a recording method that is adopted when a nozzle pitch k [dot] is at least 2 along the auxiliary scanning direction in the head unit 30. In the interlaced recording method, raster lines that cannot be recorded remain between adjacent nozzles in one main scan, and the pixels on these raster lines are recorded during other main scans. In this Specification, "Printing method" and "Recording method" are synonyms.

Figure 15A:
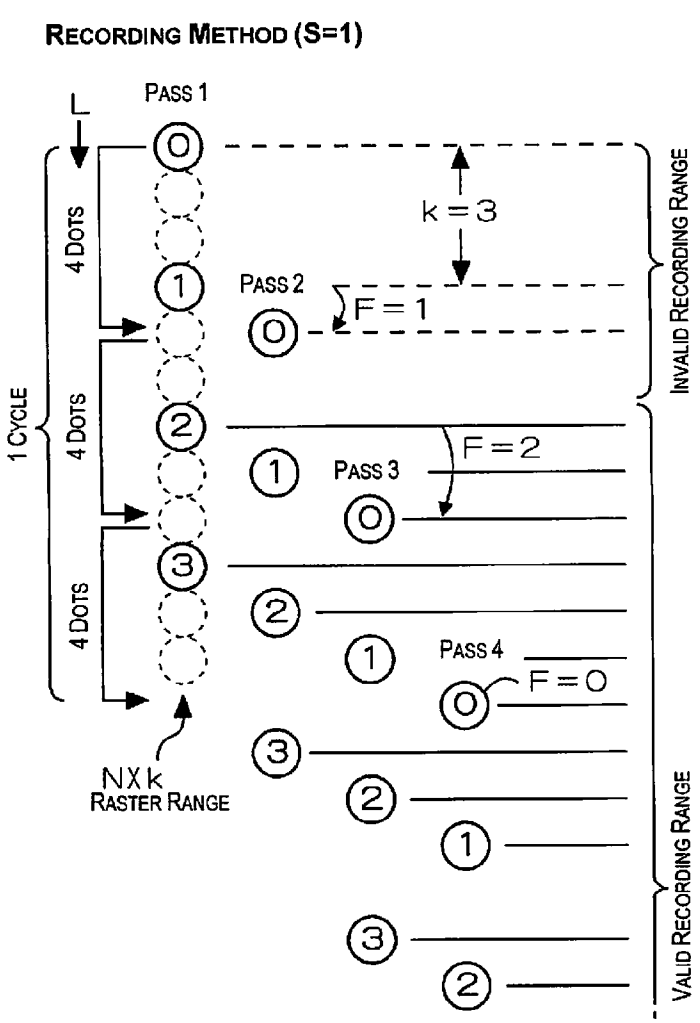
FIGS. 15A and 15B are diagrams for explaining the recording method in the color printer.
Figure 15B:
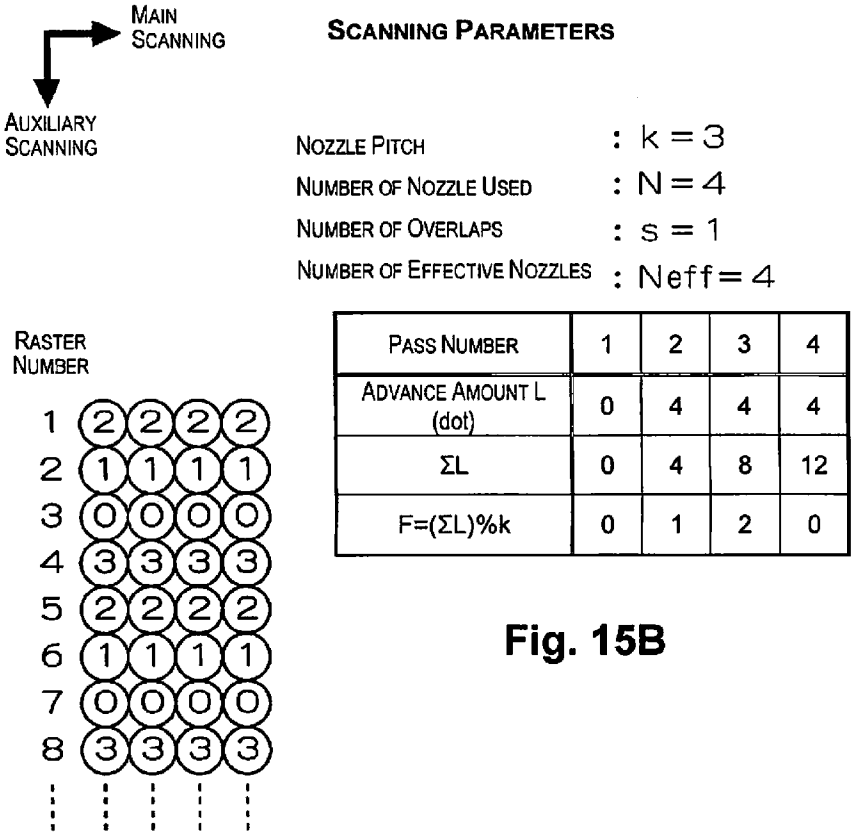

FIGS. 15A and 15B are explanatory diagrams for showing the basic conditions of a normal interlaced recording method. FIG. 15A shows an example of an auxiliary scan when four nozzles are used. FIG. 15B shows the parameters for the dot recording method.

In FIG. 15A, the circled numbers indicate the position in the auxiliary scanning direction of the four nozzles in each pass. Here, "Pass" means one main scan. The digits 0 to 3 in the circles indicate the nozzle number. The positions of the four nozzles advance in the auxiliary scanning direction at the end of each main scan. Strictly speaking, the advance in the auxiliary scanning direction is executed by using the transport motor 71 to move the print medium (see FIG. 5 and FIG. 6). Therefore, the positions of the four nozzles mean that motion is relative to the auxiliary scanning direction with respect to the print medium P.

As shown on the left end in FIG. 15A, the auxiliary scan advance amount L in this example is a constant value of 4 dots. In other words, for each auxiliary scan advance, the positions of the 4 nozzles shift by 4 dots in the auxiliary scanning direction. For each nozzle, all of the dot positions (referred to as the "pixel positions") on the respective raster lines in one main scan are the recording targets.

In this Specification, the total number of main scans conducted on each raster line (referred to as a "main scan line") is called the "number of overlaps (s)." This number of overlaps s means that s main scans are conducted on each raster line. In other words, if the number of overlaps s is 1, one main scan is conducted on each raster line. If the number of overlaps s is 2, two main scans are conducted on each raster line.

On the right end of FIG. 15A, the numbers of the nozzles for recording dots on each raster line are shown. In the raster lines drawn by dashed lines extending in the rightward direction (main scanning direction) from the circles indicating the positions in the auxiliary scanning direction of the nozzles, because at least one of the upper and lower raster lines cannot be recorded, in practice, the recording of dots is prohibited. In addition, the raster lines drawn by solid lines extending in the main scanning direction are a range in which the preceding and following raster lines are both recorded with dots. In practice, the range for recording is referred to as the effective recording range ("effective printing range," "printing execution range," or "recording execution range").

In FIG. 15B, the various parameters related to this dot recording method are shown. The parameters of the dot recording method include the nozzle pitch k [dots], the number of nozzles used [units], the number of overlaps s, the effective number of nozzles Neff [units], and the auxiliary scan advance amount L [dots].

In the example in FIGS. 15A and 15B, the nozzle pitch k is 3 dots. The number of nozzles used N is 4. The number of nozzles used N is the number of nozzles actually used within the plurality of nozzles that are installed. In this example, the number of overlaps s is 1. In addition, the effective number of nozzles Neff is the value of the number of nozzles used N divided by the number of overlaps s. This effective number of nozzles Neff can be considered to indicate the net number of raster lines that have completed the dot recording in one main scan.

The table in FIG. 15B shows the auxiliary scan advance amount L in each pass, the cumulative value ΣL, and the offset F of the nozzle. Here, the offset F is the value that indicates the separation in dots of the position of the nozzle in each pass from the reference position in the auxiliary scanning direction when the periodic position of the nozzle in the initial pass 1 (position every 4 dots in FIGS. 15A and 15B) is assumed to be the reference position with an offset of 0. For example, as shown in FIG. 15A, after pass 1, the nozzle position moves in the auxiliary scanning direction by only the auxiliary scan advance amount L (4 dots). In addition, the nozzle pitch k is 3 dots. Consequently, the offset F of the nozzle in pass 2 is 1 (see FIG. 15A).

Similarly, the nozzle position in pass 3 is the movement of ΣL=8 dots from the initial position, and the offset F is 2. The nozzle position in pass 4 is the movement of ΣL=12 dots from the initial position, and the offset F is 0. The offset F of the nozzle in pass 4 returns to 0 after three auxiliary scan advances. The three auxiliary scans constitute one cycle. By repeating this cycle, all of the dots on the raster lines in the effective recording range can be recorded.

As is clear from the example in FIGS. 15A and 15B, when the nozzle position is the position separated by only an integer multiple of the nozzle pitch k from the initial position, the offset F is zero. In addition, the offset F is given by the remainder (ΣL) % k of the cumulative value ΣL of the auxiliary scan advance amount L divided by the nozzle pitch k. Here "%" is an operator that indicates the remainder of division. If the initial position of the nozzle is considered to be a periodic position, the offset F can be considered to indicate an offset in the phase from the initial position of the nozzle.

When the number of overlaps s is 1, the following conditions must be satisfied so that there is no skipping or duplication on the raster line that is the recording target in the effective recording range.

Condition c1: The number of auxiliary scan advances in one cycle is equal to the nozzle pitch k.

Condition c2: The offset F of the nozzle after each auxiliary scan advance in one cycle becomes a different value, respectively, in the range from 0 to (k−1).

Condition c3: The average advance amount (ΣL/k) of the auxiliary scan is equal to the number of nozzles used N. In other words, the cumulative value ΣL of the auxiliary scan advance amount L per one cycle is equal to the value of the number of nozzles used N multiplied by the nozzle pitch k (N×k).

The above conditions can be understood from the following considerations. Because (k−1) raster lines are between adjacent nozzles, recording is conducted on these (k−1) raster lines in one cycle, and the number of auxiliary scan advances in one cycle becomes k times in order to return to the reference position of the nozzle (position when the offset F is zero). If the auxiliary scan advances in one cycle are less than k times, skips occur in the raster lines being recorded. If the auxiliary scan advances in one cycle exceed k times, duplications occur on the raster lines being recorded. Thus, the above condition c1 is established.

Next, when the auxiliary scan advances in one cycle occur k times, there are no skips nor duplications in the recorded raster lines only when the values of the offset F after each auxiliary scan advance are mutually different in the range from 0 to (k−1). Thus, condition c2 is established.

If both conditions c1 and c2 are satisfied, each of the N nozzles record onto k raster lines in one cycle. Thus, N×k raster lines are recorded in one cycle. On the other hand, if condition c3 is satisfied, as shown in FIG. 15A, the nozzle position after one cycle (after k auxiliary scan advances) goes to the position separated by N×k raster lines from the initial nozzle position.

Thus, by satisfying conditions c1, c2, and c3, skips and duplications in the recorded raster lines can be eliminated in the range of these N×k raster lines.

Figures 16A, 16B:
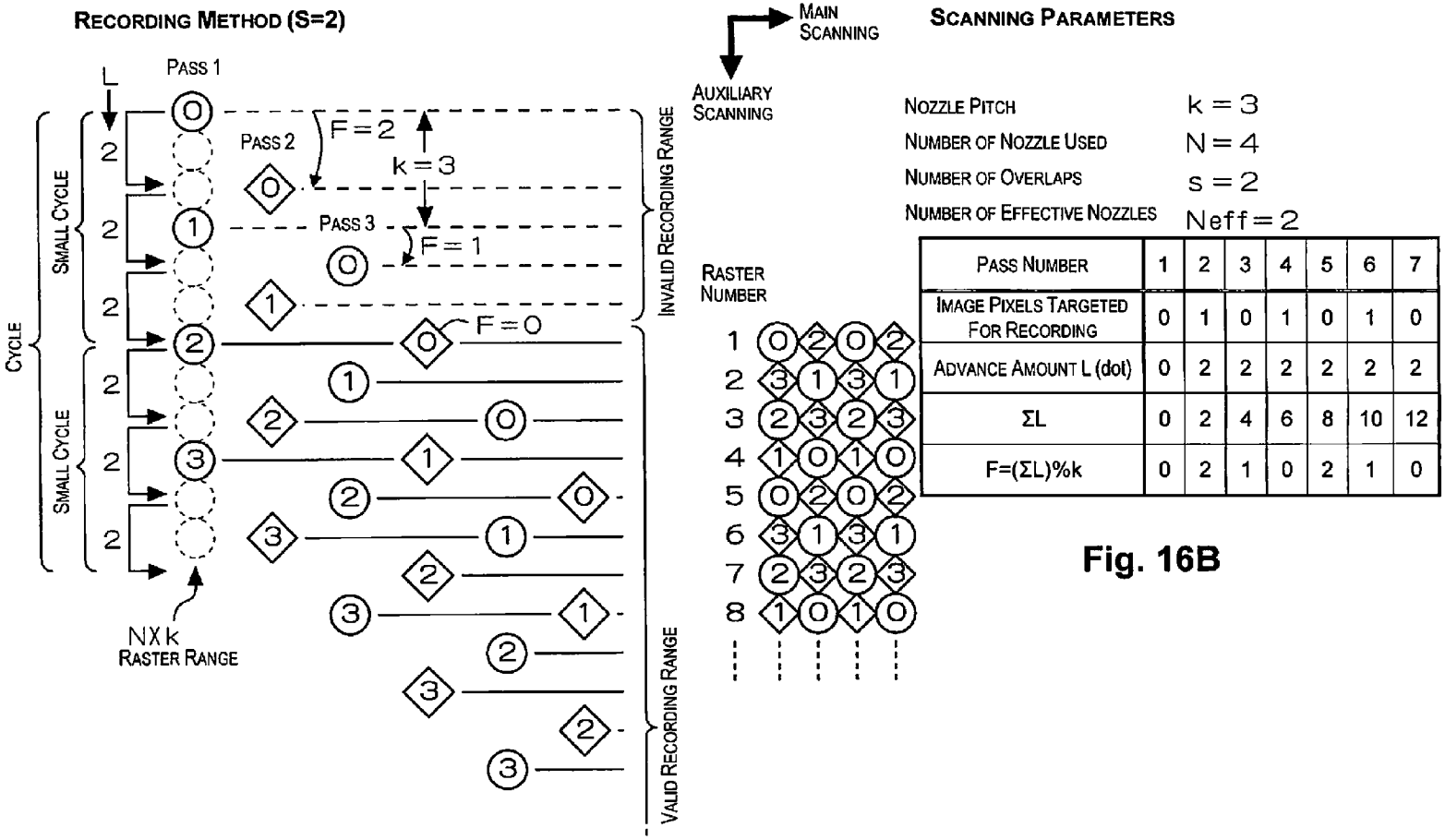
FIGS. 16A and 16B are diagrams for explaining the recording method in the color printer.

FIGS. 16A and 16B are explanatory diagrams that illustrates the basic conditions of the dot recording method when the number of overlaps s is 2 or more. When the number of overlaps s is 2 or more, s main scans are conducted on the same raster line. Therefore, the dot recording method for a number of overlaps s of 2 or more is referred to as the overlapping method.

The dot recording method shown in FIGS. 16A and 16B has values that have been changed for the number of overlaps s and the auxiliary scan advance amount L among the parameters of the dot recording method shown in FIG. 15B. The auxiliary scan advance amount L in the dot recording method in FIGS. 16A and 16B is a constant value of 2 dots as is clear from FIG. 16A in the same drawing.

In FIG. 16A in the same drawing, the nozzle positions in the even passes are indicated by diamonds to distinguish them from the nozzle positions (circles) in the odd passes.

Usually, as shown on the right side in FIG. 15A, the dot positions recorded in the even passes are the dot positions recorded in the odd passes shifted by only 1 dot in the main scanning direction. Thus, the plurality of dots on the same raster line is intermittently recorded by two different nozzles. For example, the raster line at the topmost end of the effective recording range is intermittently recorded at every other dot by nozzle 0 in pass 5 after every other dot was recorded by nozzle 2 in pass 2. In this overlapping method, each nozzle is driven with intermittent timing so that the recording of (s−1) dots is prohibited after 1 dot is recorded in one main scan.

Thus, an overlapping method that has the recording targets of intermittent pixel positions on the raster lines during each main scan is referred to as the "intermittent overlapping method." Instead of targeted recording at intermittent pixel positions, all of the pixel positions on the raster lines during each main scan may be the recording targets. That is, when the main scan is executed s times on one raster line, the overstriking of dots at the same pixel position may be allowed. This overlapping method is referred to as the "overstrike overlapping method" or the "complete overlapping method."

In addition, in the intermittent overlapping method, the position in the main scanning direction of a plurality of nozzles that are recording onto the same raster line may be mutually shifted. Various shift amounts other than the one in FIG. 16A have been considered as the actual shift amount in the main scanning direction during each main scan. For example, the dots at the positions indicated by circles can be recorded without shifting in the main scanning direction in pass 2, and the dots at the positions indicated by the diamonds that are shifted in the main scanning direction in pass 5 can be recorded.

In the bottom row in the table in FIG. 16B, the value of the offset F of each pass in one cycle is indicated. One cycle includes 6 passes. The offset F in each pass from pass 2 to pass 7 includes two values each in the range from 0 to 2. The change in the offset F in the three passes from pass 2 to pass 4 equals the change in the offset F in the three passes from pass 5 to pass 7. As shown on the left side of FIG. 16A in the same drawing, the six passes in one cycle can be divided into two groups of small cycles of three passes each. One cycle is complete when a small cycle has been repeated s times.

When the number of overlaps s is the integer 2 or more, the conditions c1 to c3 described above are rewritten as the following conditions c1b, c2b, c3b.

Condition c1b: The number of auxiliary scan advances in one cycle is equal to the value of the product of the nozzle pitch k and the number of overlaps s (k×s).

Condition c2b: The offset F of the nozzle after each auxiliary scan advance in one cycle is a value in the range from 0 to (k−1), each value is repeated every s times.

Condition c3b: The average advance amount of the auxiliary scan $\{\Sigma L/(k\times s)\}$ is equal to the effective number of nozzles Neff (=N/s). In other words, the cumulative value ΣL of the auxiliary scan advance amount L per cycle is equal to the product $\{Neff\times(k\times s)\}$ of the effective number of nozzles Neff multiplied by the number of auxiliary scans (k×s).

The conditions c1b, c2b, c3b described above also hold when the number of overlaps s is 1. That is, conditions c1b, c2b, c3b are conditions that are generally established in relation to the interlaced recording method unrelated to the value of the number of overlaps s.

Therefore, if conditions c1b, c2b, c3b are satisfied, there can be no skips or unwanted duplications of recorded dots in the effective recording range. However, when the overlapping method is adopted, a requirement is the condition that the recording positions of the nozzles recording on the same raster line are mutually shifted in the main scanning direction. In addition, when the overstrike overlapping method is adopted, conditions c1b, c2b, c3b described above may be satisfied, and all of the pixel positions in each pass are recording targets.

The case in which the auxiliary scan advance amount L is a constant value in FIGS. 15A and 16B and FIGS. 16A and 16B was explained. However, the conditions c1b, c2b, c3b described above are not limited to the case in which the auxiliary scan advance amount L is a constant value, and is also applicable when a combination of a plurality of different values is used as the auxiliary scan advance amount.

In this embodiment, when the user opens the printing condition setting window (see FIG. 2) to select the type of print medium and type of print quality, in the color printer 1, the number of overlaps and the meniscus mode in lap units are set to correspond to the combination of selections, and the resolution is set to correspond to the combination of the print mode corresponding to the type of selected print medium and the selected print quality.

Here, when "Plain paper," "Recycled paper," or "Fine paper" is selected as the print medium, the "Plain paper printing mode" results. In this "Plain paper printing mode," when "Pretty" is selected as the print quality, the number of overlaps is set to be larger than for "Fast," and the meniscus mode switches from "Normal" to "High" during printing.

For example, when "Recycled paper" is selected as the print medium, and "Pretty" is selected as the print quality, the number of overlaps is set to "4." Of these, the meniscus mode is set to "Normal" in the first and second laps in the first half; and the meniscus mode is set to "High" in the third and fourth laps in the last half. Corresponding to the combination of the "Plain paper printing mode" for the selected "Recycled paper" and the selected "Pretty," the resolution is set to 600×600 [dpi].

The main ingredient in plain paper is cellulose fiber that functions as the ink receiving layer for receiving ink. Therefore, when ink droplets are ejected onto plain paper, ink penetrates along the fiber direction. When a plurality of ink droplets is ejected onto plain paper and the like, the cockling phenomenon easily occurs in which the allowed amount that the cellulose fibers, which are the ink receiving layer, can absorb is exceeded, and a waviness state results.

Here, this embodiment is configured so that when plain paper is selected as the print medium and the plain paper printing mode results, and when "Pretty" is selected as the print quality, the meniscus mode switches from "Normal" to "High" during the plurality of laps (passes).

Therefore, in this embodiment, even when the constituent fibers of the paper infiltrate the nozzles due to cockling during printing, the possibility of the fibers touching the ink and the possibility of the paper, which is the print medium, being soiled can be kept to a minimum.

Figure 17A:
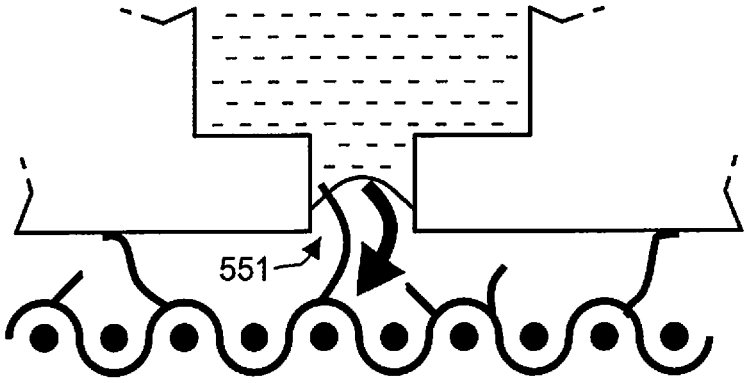
FIGS. 17A and 17B are diagrams showing the problems when constituent fibers infiltrate the nozzle.
Figure 17B:
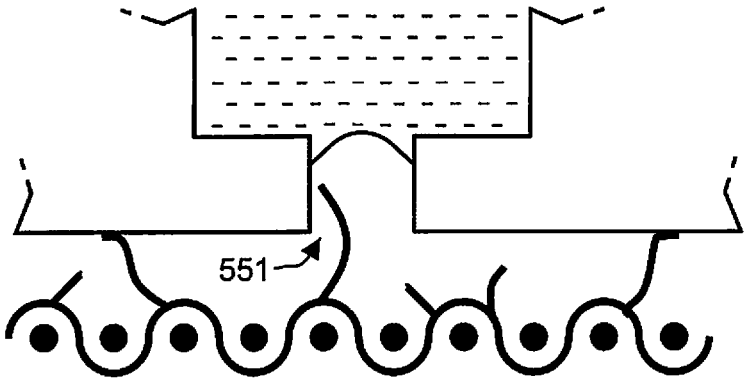

For example, when the meniscus position of a nozzle 551 is drawn in as shown in FIG. 17B, even when the ends of the constituent fibers of the print medium enter into the nozzle 551 due to cockling, compared to when the position of the meniscus m is not drawn in FIG. 17A, the possibility of contact with ink becomes low. Therefore, in this embodiment, the risk of soiling the print medium can be reduced.

When "Plain paper" or "Recycled paper" is selected in the printing mode, and "Fast" is selected as the print quality, the number of overlaps is set to "1," and the meniscus mode does not have to be switched during printing.

In addition, the fibers of "Fine paper" are minute compared to those of "Plain paper" or "Recycled paper," and the allowed amount of ink that can be absorbed is large. Therefore, when "Fine paper" is selected as the print medium, the number of overlaps becomes larger than that for plain paper or recycled paper (compared when both have the same print quality).

In addition, when photographic paper such as "Photo paper" is selected as the print medium, the "Photographic paper printing mode" results. When "Pretty" is selected in this "Photographic paper printing mode," the number of overlaps is set to be larger than that for "Fast," and the meniscus mode is fixed at "Normal" in common with the "Plain paper printing mode."

For photographic paper and the like, the ink receiving layer is coated, where a representative layer is composite silica on the top (surface) of the base paper layer of, for example, polyethylene terephthalate or cellulose fibers. Therefore, the ink droplets ejected onto the photographic paper are well ordered and a large amount penetrates (diffusion). Therefore, in the "Photographic paper printing mode," cockling of the photographic paper does not have to be considered, and the meniscus mode is fixed at "Normal."

When "Synthetic fibers" or "Natural fibers" are selected as the print medium, the "Cloth printing mode" results. When "Pretty" is selected as the print quality in this "Cloth printing mode," the "Plain paper selection mode" is shared when the number of overlaps is set to be greater than that for "Fast."

However, when "Pretty" is selected as the print quality, while the meniscus mode is fixed at "High" for "Synthetic fibers," the meniscus mode for "Natural fibers" switches from "High" to "Normal" during printing.

The reason is as follows. "Synthetic fibers," specifically, polyester, acrylic, nylon, and the like, have difficulty in absorbing ink (water). Therefore, when "Synthetic fibers" are selected as the print medium, the meniscus mode is set to "High" unrelated to the print quality. Thus, even if fibers infiltrate due to nap the nozzles, the possibility of the fibers coming into contact with ink is reduced.

In addition, "Natural fibers," for example, cotton and silk, form nap on the surface compared to plain paper and the like, but because ink (moisture) is more readily absorbed compared to plain paper and the like, even if initially napped, the nap is suppressed by the ejection of ink droplets a plurality of times. Therefore, when "Natural fibers" are selected as the print medium and the cloth printing mode results, and when "Pretty" is selected as the print medium, the meniscus mode is initially set to "High" at the start of printing. Thus, even if fibers infiltrate the nozzles, the possibility of the fibers coming into contact with the ink becomes low. In this case, napping of the fibers is suppressed by the ejection of ink droplets a plurality of times during printing, and the meniscus mode is switched to "Normal" during printing. Specifically, the number of overlaps is set to "16," and the meniscus mode is set to "High" in the first half of laps from the first to the eighth laps and to "Normal" in the final half of laps from the ninth to the sixteenth laps.

According to this kind of embodiment, the position of the meniscus is appropriately set and changed in response to various combinations of the type of print media and the type of print quality; therefore, the risk of soiling the print media can be reduced.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps; but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A printing apparatus comprising:

a piezoelectric element configured to be displaced in response to voltage of a drive signal;

a cavity in which ink is filled, and whose internal volume is increased or decreased by displacement of the piezoelectric element;

a nozzle connected to the cavity and configured to eject the ink as ink droplets onto a print medium by increasing or decreasing of the internal volume of the cavity;

a printing mode receiver configured to receive selection of at least one photographic paper printing mode for printing onto photographic paper and at least two plain paper printing modes for printing onto plain paper from among printing modes; and a control unit configured to control a meniscus position in the nozzle to be separated further from an orifice surface of the nozzle when the selection of one plain paper printing mode from among the at least two plain paper printing modes is received by the printing mode receiver than when the selection of the photographic paper printing mode is received.

2. The printing apparatus according to claim 1, wherein when printing is executed in a plurality of passes in the plain paper printing modes, the control unit is configured to control the meniscus position of the nozzle in an initial pass to be separated further from the orifice surface of the nozzle than the meniscus position of the nozzle in a final pass.

3. The printing apparatus according to claim 1, wherein the control unit has a printing mode that executes printing in a plurality of passes exists, and that controls the meniscus position of the nozzle in a final pass to be separated further from the orifice surface of the nozzle than the meniscus position of the nozzle in an initial pass.

4. A control method of a printing apparatus that includes a piezoelectric element configured to be displaced in response to voltage of a drive signal, a cavity in which a liquid is filled, and whose internal volume is increased or decreased by displacement of the piezoelectric element, and a nozzle connected to the cavity and configured to eject ink as ink droplets onto a print medium by increasing and decreasing the internal volume of the cavity, the control method comprising:

receiving selection of at least one photographic paper printing mode for printing onto photographic paper and at least two plain paper printing modes for printing onto plain paper from among printing modes; and controlling a meniscus position in the nozzle to be separated further from an orifice surface of the nozzle when the selection of one plain paper printing mode from among the at least two plain paper printing modes is received than when the selection of the photographic paper printing mode is received.

5. A non-transitory computer readable medium storing a program causing a computer connected to the printing apparatus that includes a piezoelectric element configured to be displaced in response to voltage of a drive signal, a cavity in which a liquid is filled, and whose internal volume is increased or decreased by displacement of the piezoelectric element, and a nozzle connected to the cavity and configured to eject the liquid as ink droplets onto a print medium by increasing or decreasing the internal volume of the cavity, to act as a printing mode receiver configured to receive selection of at least one photographic paper printing mode for printing onto photographic paper and at least two plain paper printing modes for printing onto plain paper from among printing modes; and a control unit configured to control a meniscus position in the nozzle to be separated further from an orifice surface of the nozzle when the selection of one plain paper printing mode from among the at least two plain paper printing modes is received by the printing mode receiver than when the selection of the photographic paper printing mode is received.

* * * * *